United States Patent [19]

Isogai

[11] Patent Number: 4,536,772

[45] Date of Patent: Aug. 20, 1985

[54] THERMAL TRANSFER PRINTING APPARATUS

[75] Inventor: Mitsuhiro Isogai, Tokyo, Japan

[73] Assignee: Sony Corporation, Tokyo, Japan

[21] Appl. No.: 468,944

[22] Filed: Feb. 23, 1983

[30] Foreign Application Priority Data

Feb. 24, 1982 [JP] Japan ..... 57-27516

[51] Int. Cl.[3] ..... B41J 3/70

[52] U.S. Cl. ..... 346/76 PH; 400/120

[58] Field of Search ..... 346/76 PH, 76 R, 134, 346/138, 105, 106; 400/120, 240.4, 240.3, 208, 196.1, 224.1, 224.2, 525–530; 219/216; 358/75

[56] References Cited

U.S. PATENT DOCUMENTS 4,388,628 1/1983 Moriguchi et al. ..... 400/120

FOREIGN PATENT DOCUMENTS 0020212 9/1980 European Pat. Off. .

3883 1/1983 Japan ..... 400/120

*Primary Examiner*—E. A. Goldberg

*Assistant Examiner*—A. Evans

*Attorney, Agent, or Firm*—Lewis H. Eslinger; Alvin Sinderbrand

[57] ABSTRACT

In a thermal transfer printing apparatus in which a thermal head having a series of selectively energized heating elements arranged substantially along a straight line is pressed against a platen roller with a sheet or ribbon carrying thermally transferable dye material and printing paper interposed therebetween for the selective transfer of the dye material to the printing paper in dependence on the selective energization of the heating elements, the platen roller and thermal head are arranged for shifting relative to each other in the direction of the straight line along which the heating elements are arranged so as to permit improved resolution of the printed image. More particularly, in printing a full color image composed of various different color components including a black component, the platen roller and thermal head are shifted relative to each other, as aforesaid, by one-half the pitch between the heating elements of the thermal head when printing the black component of the printed image so that the black dye material will be transferred to the printing paper at interstices between the transferred dye materials constituting the other color components of the printed image.

17 Claims, 23 Drawing Figures

FIG. 5
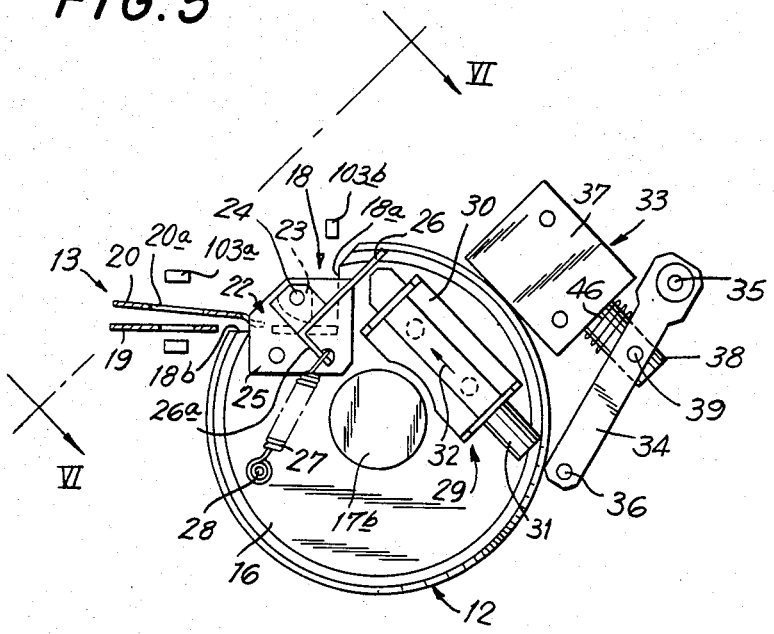
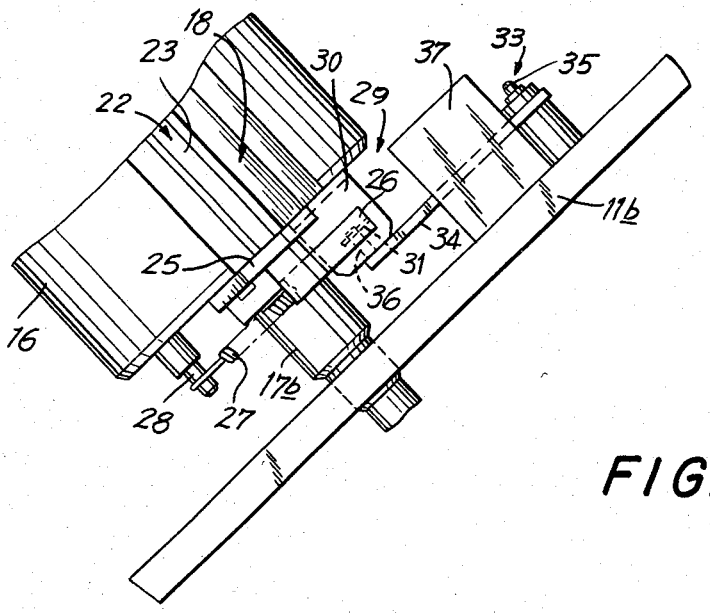
FIG. 6

THERMAL TRANSFER PRINTING APPARATUS

BACKGROUND OF THE INVENTION

1. Field of the Invention

This invention relates generally to a thermal transfer printing apparatus, and more particularly is directed to improvements in a thermal transfer printing apparatus of the type in which a thermal head having heating elements arranged along a substantially straight line is pressed against a platen with a ribbon or sheet carrying thermally transferable dye material and printing paper interposed therebetween for the selective transfer of the dye material to the printing paper in dependence on the selective energization of the heating elements.

2. Description of the Prior Art

In a thermal transfer printing apparatus of the type described above, the heating elements provided on the thermal head are necessarily spaced from each other so that each element can be heated substantially independently of the adjacent elements. By reason of the resulting gaps between the heating elements of the thermal head, there is deficient transfer of dye material to the printing paper at the regions corresponding to the gaps with the result that the overall density of the printed image and the resolution thereof are less than desired.

OBJECTS AND SUMMARY OF THE INVENTION

Accordingly, it is an object of this invention to provide a thermal transfer printing apparatus which avoids the foregoing problem encountered in the prior art.

More specifically, it is an object of this invention to provide a thermal transfer printing apparatus of the described type which provides a printed image of improved quality, particularly in respect to its density and resolution.

In accordance with an aspect of this invention, in a thermal transfer printing apparatus of the type comprising a platen having a surface for backing up printing paper, a thermal head having a plurality of selectively energizable heating elements confronting the surface of the platen and arranged substantially along a straight line, ink carrying means for positioning thermally transferable dye material between the heating elements and the printing paper backed up by the platen surface, means for pressing the thermal head toward the platen with the ink carrying means and printing paper therebetween for the selective transfer of the dye material to the printing paper in dependence on the selective energization of the heating elements, and means for moving the thermal head and printing paper relative to each other in a direction extending transversely in respect to the straight line along which the heating elements are arranged; there is further provided a shifting means for moving the thermal head and the printing paper relative to each other in the direction along said straight line. Such relative movement in the direction along said straight line is preferably effected from a first position to a second position over a distance substantially equal to one-half the pitch between the successive heating elements so that, when in said second position, the dye material will be transferred to the printing paper at interstices between the locations at which the dye material is transferred to the printing paper when the thermal head and printing paper are disposed relative to each other in the first position.

In the case where a full color image is to be printed and is, for example, comprised of cyan, magenta, yellow and black components transferred by the thermal head to the printing paper from sheets carrying respectively differently colored thermally transferable dye materials, it is a feature of this invention that the cyan, magenta and yellow components of the full color image are transferred with the thermal head and printing paper in the first position relative to each other in the direction of the straight line along which the heating elements are arranged, and the black component of the image is transferred with the thermal head and printing paper in the second relative position so that the black component of the image is formed of dye material deposited in interstices between the other colored components for improving the density and resolution of the resulting image.

The above, and other objects, features and advantages of this invention, will be apparent in the following detailed description of an illustrative embodiment thereof which is to be read in connection with the accompanying drawings wherein like parts are identified by the same reference numerals in the various views.

BRIEF DESCRIPTION OF THE DRAWINGS

FIG. 5 is an enlarged side elevational view showing details of a paper gripping mechanism associated with the platen roller in the apparatus of FIGS. 1–3;

FIG. 6 is a fragmentary elevational view of the paper gripping mechanism as viewed in the direction of the arrows VI—VI on FIG. 5;

FIG. 1 is a side elevational view of a mechanism included in the thermal transfer printing apparatus according to this invention for axially shifting its platen roller;

DETAILED DESCRIPTION OF A PREFERRED EMBODIMENT

Figure 1:
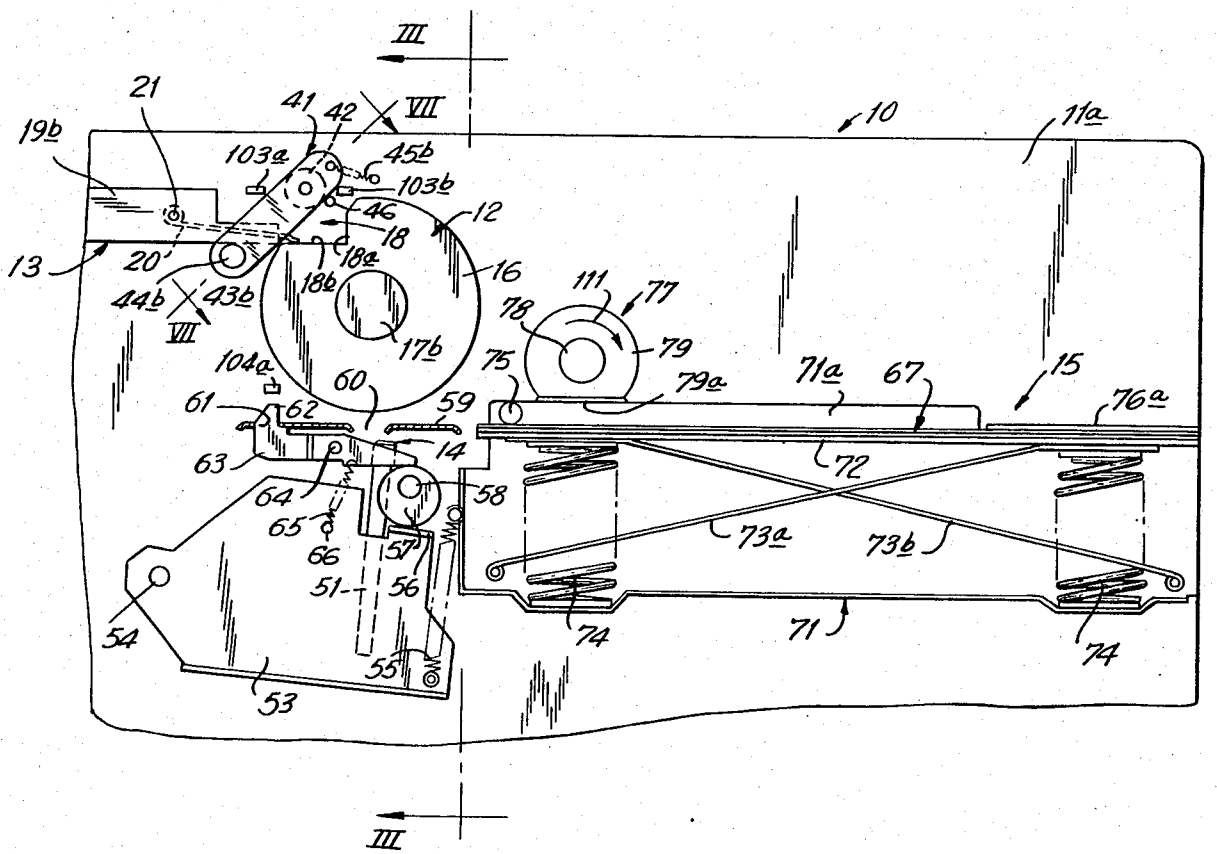
FIG. 1 is a side elevational view of a thermal transfer printing apparatus according to an embodiment of this invention, with a side frame member of such apparatus being removed for better illustrating the working components thereof.
Figure 2:
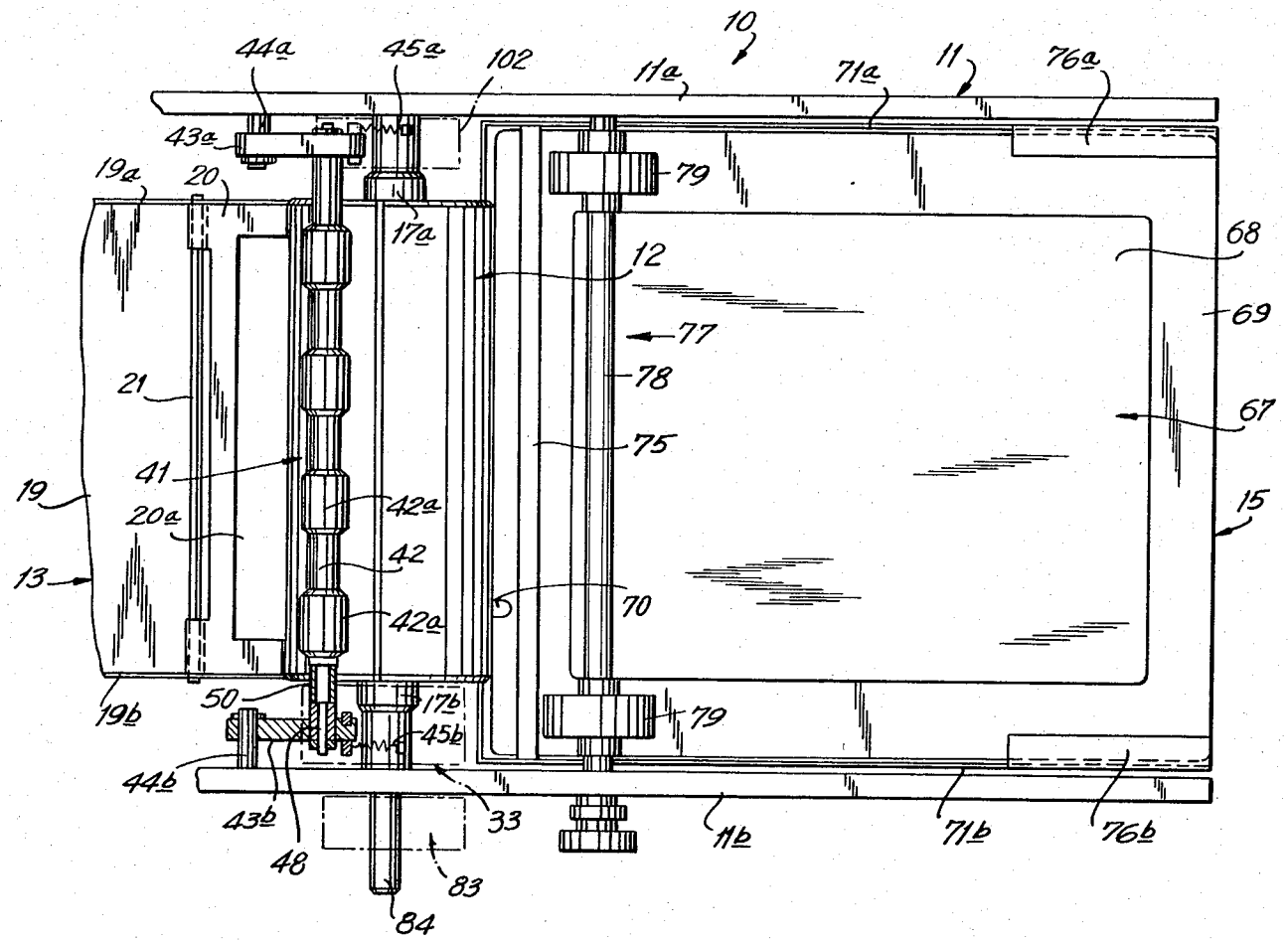
FIG. 2 is a top plan view of the apparatus of FIG. 1.
Figure 3:
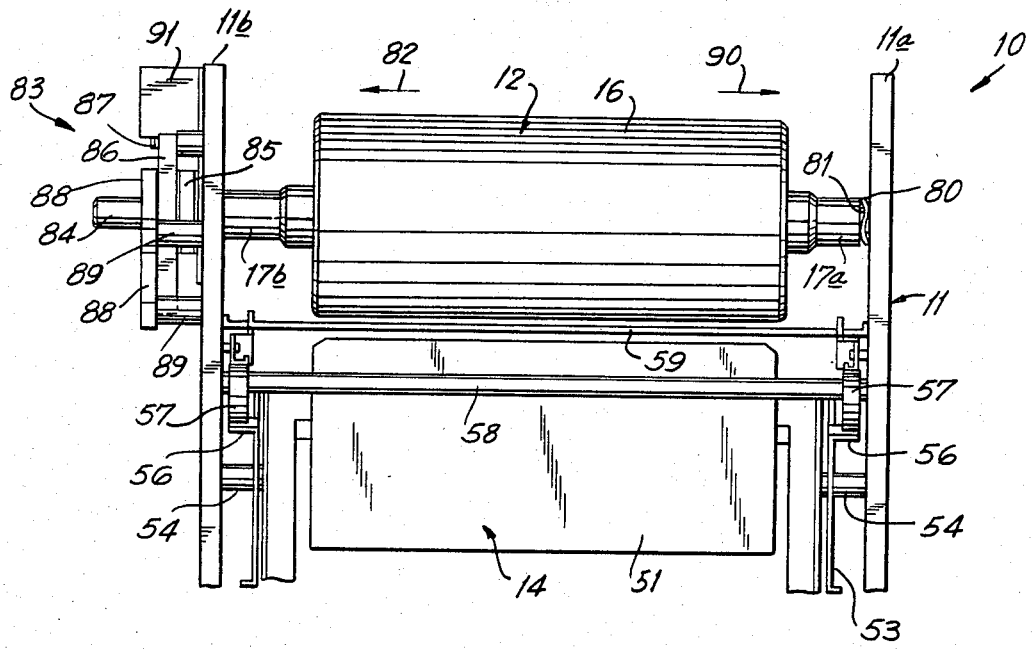
FIG. 3 is a sectional view taken along the line III—III on FIG. 1.

Referring to the drawings in detail, and initially to FIGS. 1–3, thereof, it will be seen that a thermal transfer printing apparatus 10 according to an embodiment of this invention generally comprises a frame 11 having spaced apart side frame members 11*a* and 11*b* between which there are mounted a platen 12 for backing-up or supporting printing paper supplied thereto along a paper guide assembly 13, and a thermal head 14 for selectively transferring thermally transferable dye material to printing paper backed-up by platen 12 from a carrier for the dye material which is fed between the printing paper and thermal head 14 from a magazine 15 storing the carrier for the ink or dye material.

In the illustrated apparatus 10, platen 12 is shown to be in the form of a roller having a generally cylindrical body 16 which, at least at its outer peripheral portion, is formed of rubber or the like so as to present an elastic surface about which the printing paper may be wrapped. Trunnions or axle portions 17*a* and 17*b* project axially from the opposite ends of platen roller body 16 and are journaled in suitable bearings within side frame members 11*a* and 11*b*, respectively. Body 16 is further formed with a recess 18 extending axially along its peripheral surface and being defined by relatively flat surfaces 18*a* and 18*b* at right angles to each other. In an initial or paper receiving and discharging position of platen roller 12, as shown on FIGS. 1 and 5, recess 18 is at the upper portion of the platen roller with surface 18*b* extending substantially horizontally and surface 18*a* extending upwardly and facing toward paper guide assembly 13.

Figure 12:
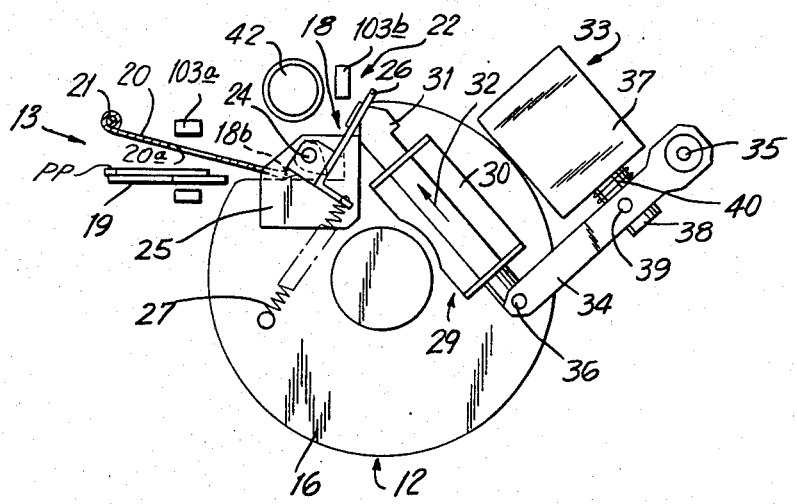
FIGS. 12 and 13 are views similar to that of FIG. 5, but illustrating the operation of the paper gripping mechanism in receiving and then gripping a sheet of printing paper fed to the platen roller.

The paper guide assembly 13 is shown to include a paper guiding channel 19 having upstanding flanges 19*a* and 19*b* along its opposite side edges and extending adjacent to the periphery of platen roller 12 at approximately the level of surface 18*b* of recess 18 in the described initial position of the platen roller. Thus, in the case where the printing paper is in the form of individual sheets thereof, each sheet can be manually advanced along guiding channel 19 so as to project its leading edge portion into recess 18 and against surface 18*a* acting as a stop with platen roller 12 in its initial position. Paper guiding mechanism 13 further includes a flap 20 disposed above the bottom surface of channel 19 and being pivoted on a shaft 21 which, it its opposite ends, is mounted in flanges 19*a* and 19*b*. As shown particularly on FIGS. 12–15, flap 20 extends from pivot shaft 21 in the direction toward platen roller 12 beyond the adjacent end edge of channel 19. Thus, when platen roller 12 is in its initial position, as on FIGS. 5, 12 and 13, flap 20 is inclined downwardly from shaft 21 and, at its free edge portion, extends into recess 18 and rests upon surface 18*b* of the latter. However, when platen roller 12 is turned away from its initial position, for example, as on FIG. 15 or FIG. 21, flap 20 rides, at its free edge portion, on the peripheral surface of platen roller 12 and is tilted upwardly from its pivot shaft 21.

For the purpose of wrapping a sheet of printing paper about the peripheral surface of the body 16 of platen roller 12, apparatus 10 is shown to further comprise a paper gripping mechanism 22 including a gripping cam 23 extending longitudinally within recess 18 and fixed on a shaft 24 which, at its opposite ends, is rotatably mounted in support plates 25 secured to the adjacent end faces of platen roller body 16 (FIGS. 5 and 6). In order to operate gripping cam 23, an operating arm 26 is secured to the end of shaft 24 adjacent side frame member 11*b* and is formed with an anchor tab 26*a* (FIG. 5) connected to one end of a tension spring 27 which, at its other end, is secured to an anchor pin 28 extending from the adjacent end face of roller body 16. Spring 27 is effective to urge gripping cam 23 to turn in the clockwise direction about the axis of shaft 24, as viewed in FIGS. 5 and 21, for urging an edge of gripping cam 23 toward surface 18*b* of recess 18, and thus making gripping cam 23 operative to grip an edge portion of a sheet of printing paper PP against surface 18*b* within recess 18. A cam releasing mechanism 29 is shown to include a bracket 30 fixed to the end face of roller body 16 adjacent side frame member 11*b* and supporting a bolt member 31 which is slidable in a longitudinal direction substantially at right angles to operating arm 26. Thus, when bolt member 31 is longitudinally displaced in the direction of the arrow 32 on FIG. 5, one end of bolt member 31 acts against operating arm 26 to turn the latter in the counterclockwise direction as viewed on FIG. 5, that is, in the direction opposed by spring 27, with the result that gripping cam 23 is released or moved away from surface 18*b* for freeing an end edge portion of a sheet of printing paper therebetween. An actuating mechanism 33 for the cam releasing mechanism 29 is mounted on side frame member 11*b* and is located for engagement with the cam releasing mechanism 29 only when platen roller 12 is in its initial position, that is, the position in which surface 18*b* of recess 18 extends substantially horizontally at the end of paper guiding channel 19. Such actuating mechanism 33 is shown to include an actuating lever 34 pivotally supported at one end, as at 35, on side frame member 11*b*, and having a pin 36 extending from its opposite or free end so as to be engageable with an end of bolt member 31 when platen roller 12 is in its initial position. A solenoid 37 is secured to side frame member 11*b* and has an armature 38 pivotally connected, as at 39, to actuating lever 34. A compression spring 40 is provided on armature 38 to urge the latter to an extended position, as shown on FIG. 5, in which actuating lever 34 is in an inactive position, that is, has its pin 36 spaced from the adjacent end of bolt member 31 even with platen roller 12 in its initial position. However, when solenoid 37 is energized with platen roller 12 in its initial position, the solenoid armature 38 is retracted against the force of spring 40, as on FIG. 12, and arm 34 is angularly displaced in the clockwise direction about its pivot 35 to cause pin 36 to longitudinally displace bolt member 31 in the direction of arrow 32. Upon such longitudinal displacement of bolt member 31, the latter acts against operating arm 26 of paper gripping mechanism 22 for releasing gripping cam 23.

Figure 7:
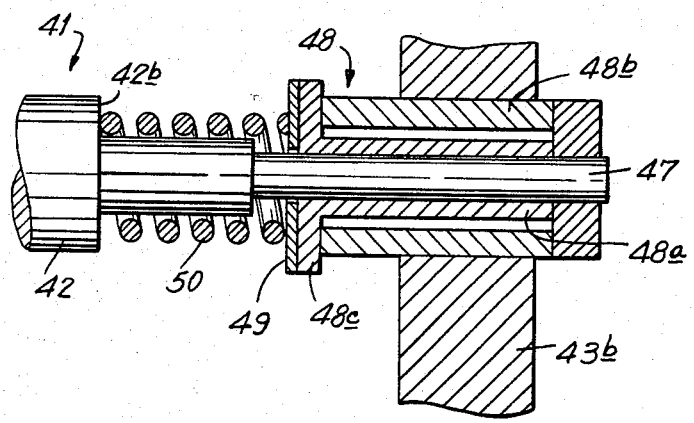
FIG. 7 is an enlarged fragmentary sectional view taken along the line VII—VII on FIG. 1, and showing details of a mechanism by which printing paper is tensioned when being wrapped about the platen roller.

Referring now to FIGS. 1, 2 and 7, it will be seen that for the purpose of wrapping a sheet of printing paper smoothly about platen roller 12, the apparatus 10 further comprises a sheet tensioning mechanism 41 which is engageable with a sheet of printing paper gripped by the gripping mechanism 22 for yieldably resisting movement of the gripped sheet with platen roller 12 when the latter is rotated in the clockwise direction as viewed in FIG. 1. More particularly, the sheet tensioning mechanism 41 includes a tension roller 42 journaled at its opposite ends in support arms 43*a* and 43*b* which are, in turn, pivotally mounted at 44*a* and 44*b*, on side frame members 11*a* and 11*b*, respectively. Springs 45*a* and 45*b* are connected between pivoted support arm 43*a* and side frame member 11*a*, and between pivoted support arm 43*b* and side frame member 11*b*, respectively, and are operative to urge arms 43*a* and 43*b* to pivot in the clockwise direction, as viewed on FIG. 1, and thereby to urge radially raised portions 42*a* of tension roller 42 against the peripheral surface of platen roller 12. Stop pins 46 are directed inwardly from side frame members 11*a* and 11*b* and are engageable by support arms 43*a* and 43*b*, respectively, for limiting the swinging of the latter by springs 45*a* and 45*b*, and thereby preventing the entry of tension roller 42 into recess 18 of platen roller 12 when the latter is in its initial position shown on FIG. 1.

As shown particularly on FIG. 7, at each of the ends of tension roller 42, the shaft 47 thereof is freely rotatable in the inner sleeve 48*a* of a one-way clutch mechanism 48 which further includes an outer sleeve 48*b* carried by the respective arm 43*b*. By means of a pawl and ratchet mechanism (not shown) or the like, the inner sleeve 48*a* of each one-way clutch mechanism 48 is free to rotate only in one direction relative to the respective outer sleeve 48*b*, with such direction of free rotation being clockwise, as viewed in FIGS. 1 and 21. A flange 48*c* is provided at the inner end of sleeve 48*a* and is frictionally engaged by a washer 49 urged axially thereagainst by a compression spring 50 extending axially between washer 49 and a radial shoulder 42*b* on an adjacent end of tension roller 42. It will be appreciated that, when tension roller 42 is rotated in the counterclockwise direction, as viewed on FIGS. 1, 14 and 15, that is, in the direction in which each of one-way clutch mechanism 48 prevents rotation of its inner sleeve 48*a* relative to the respective fixed outer sleeve 48*b*, the turning of roller shaft 47 in respect to inner sleeve 48*a* is frictionally resisted by washer 49 and spring 50 constituting a drag on the rotation of tension roller 42. On the other hand, when tension roller 42 is rotated in the clockwise direction, as viewed in FIGS. 1 and 21, each inner sleeve 48*a* is free to rotate in the corresponding direction relative to the respective outer sleeve 48*b* so that roller shaft 47 turns freely with inner sleeves 48*a* of the one-way clutch mechanism 48 and there is no drag imposed on such rotation of tensionn roller 42.

Figure 4:
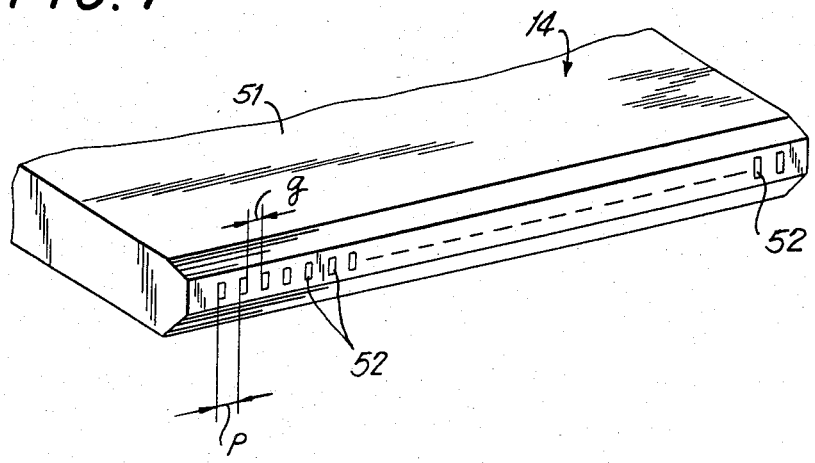
FIG. 4 is a fragmentary perspective view particularly showing the arrangement of heating elements in a thermal head that may be incorporated in the thermal transfer printing apparatus according to this invention.

As shown particularly on FIG. 4, the thermal head 14 includes a body 51 which is generally of flat, rectangular configuration, and which has a series of heating elements 52 arranged along a straight line on an edge portion of body 51. The pitch p between adjacent heating elements 52 is sufficient to provide gaps g therebetween for example of at least 15 μm. Such gaps are required so that each of the heating elements 52 can be heated, when energized by an electric current made to flow thereto, without substantial influence from, or heating by the energizing of the adjacent heating elements.

Thermal head 14 is mounted below platen roller 12 with body 51 upright so as to present heating elements 52 along the upper edge thereof which extends generally laterally parallel to the axis of platen roller 12. More particularly, body 51 of thermal head 14 is suitably secured in a mounting member or carriage 53 which is pivotally supported, as at 54, in respect to side frame members 11*a* and 11*b* so as to be swingable about a horizontal, laterally directed axis spaced substantially from thermal head 14. Thus, swinging of mounting member 53 about such axis effects upward and downward movement of thermal head 14 toward and away from, respectively, the periphery of platen roller 12 at the bottom of the latter. Tension springs 55 are connected, at one end, to side frame members 11*a* and 11*b* and, at their other end, to mounting member or carriage 53 for urging the latter to pivot upwardly and thereby press heating elements 52 of thermal head 14 against the peripheral surface of platen roller body 16. Mounting member 53 is formed with upwardly facing flanges 56 engageable, from below, with radial cams 57 fixed on opposite end portions of a shaft 58 which extends laterally and has its opposite end portions journaled in side frame members 11*a* and 11*b*. It will be appreciated that springs 55, in urging mounting member 53 in the upward direction, maintain engagement of flanges 56 with the respective cams 57 so that the position of thermal head 14 relative to platen roller 12 is determined by cams 57 on shaft 58.

In the thermal transfer printing apparatus 10, the carrier for the ink or dye material is in the form of individual sheets which, as hereinafter described, are fed one-by-one from magazine 15 onto a carrier guide plate 59 which extends horizontally under platen roller 12 and is suitably supported by side frame members 11*a* and 11*b*. The carrier guide plate 59 has an elongated slot 60 extending thereacross immediately under platen roller 12 so that heating elements 52 of thermal head 14 can reach upwardly through slot 60 for pressing a dye carrier sheet located on plate 59 against printing paper wrapped about the platen roller. Plate 59 further has apertures 61 spaced from slot 60 in the direction away from magazine 15 and through which stop elements 62 can extend upwardly for initially locating a dye carrier sheet relative to platen roller 12. Each stop element 62 is formed on one end of a stop lever 63 which is pivoted intermediate its ends on a pivot pin 64 under plate 59, and which has its end remote from stop element 62 engaging the respective cam 57 from above. A spring 65 extends from each stop lever 63 to a respective anchor pin 66 extending from the adjacent side frame members 11*a* or 11*b*. It will be appreciated that, when cams 57 are positioned as shown on FIGS. 1 and 16 so that thermal head 14 is retracted below carrier guide plate 59, each stop lever 63 is in its operative position to project its stop element 62 upwardly through aperture 61 for arresting or stopping the movement of a dye carrier sheet on plate 59.

On the other hand, when cams 57 are turned through 180° to the position shown on FIG. 17, springs 55 raise mounting member or carriage 53 so that heating elements 52 of thermal head 14 project upwardly through slot 60 of carrier guide plate 59, while cams 57 angularly displace stop levers 63 to retract the stop elements 62 of the latter below guide plate 59.

Figure 10:
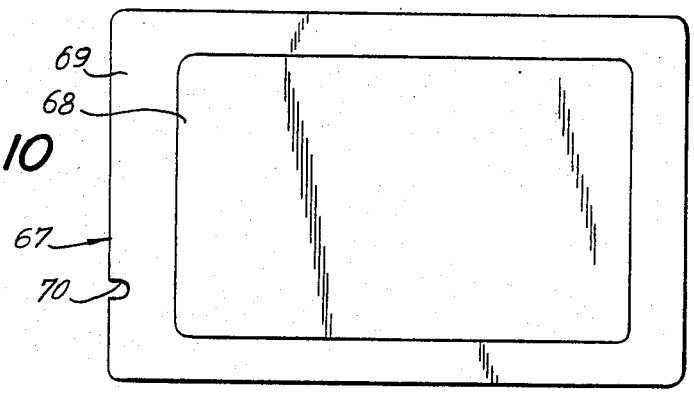
FIGS. 10 and 11 are respectively a plan view and a side view of an ink carrying member used in the illustrated embodiment of the invention.
Figure 11:
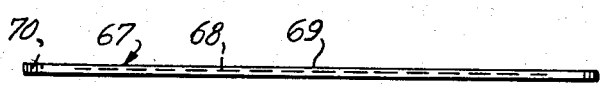

As earlier indicated, and as shown particularly on FIGS. 10 and 11, each carrier 67 for the ink or dye material is in the form of a sheet 68, for example, of paper, coated with dye and having a stiffening frame 69 extending thereabout for keeping the dye-coated paper 68 under tension and hence suitably flat. The frame 69 is desirably formed, at one end, with a suitably located cut-out or notch 70 for indicating the color of the dye coating the respective paper sheet 68. When apparatus 10 is to be used for printing full color images, carriers 67 are desirably provided in sets having the respective sheets 68 coated with dyes of different colors. More particularly, each of the sets of carriers 67 may be constituted by four sheets 68 having corresponding frames 69 and being respectively coated with cyan, magenta, yellow and black dyes. The carriers 67 are superposed on each other in magazine 15 and are removed, therefrom in sequence, and interposed one-by-one between heating elements 52 of thermal head 14 and a sheet of printing paper wrapped about platen roller 12.

As shown on FIGS. 1 and 2, magazine 15 may generally comprise a substantially rectangular carrier holder 71 suitably mounted between side frame members 11*a* and 11*b* and having a vertically movable carrier support plate 72 guided between side walls 71*a* and 71*b* of holder 71 and being maintained horizontal during its movements by pivoted links 73*a* and 73*b*. Helical coil springs 74 are interposed between the bottom of holder 71 and the underside of support plate 72 for urging the latter upwardly. The dye carriers 67 are arranged in a stack on support plate 72 and are guided laterally between side walls 71*a* and 71*b* of holder 71, and springs 74 urge the stack of dye carriers 67 upwardly as such carriers are removed one-by-one from the top of the stack. The position of the uppermost carrier 67 in the stack is established precisely at the level of guide plate 59 by engagement of that uppermost carrier 67, from below, with a guide rod 75 which extends laterally between side walls 71*a* and 71*b* adjacent the end of holder 71 near to guide plate 59, and also by inwardly directed flanges 76*a* and 76*b* provided at the upper edge portions of side walls 71*a* and 71*b* for overlying the corresponding marginal portions of the uppermost carrier 67 in the stack at the end portion of the latter remote from guide plate 59.

For the purpose of feeding the dye carriers 67 one-by-one from the stop of the stack thereof in magazine 15 onto guide plate 59, apparatus 10 is shown to include a dye carrier feed mechanism 77 having a shaft 78 journaled, at its opposite end portions, in side frame members 11*a* and 11*b* above the end portion of holder 71 adjacent platen roller 12. Feed rollers 79 are fixed on shaft 78 at axially spaced apart locations, as particularly shown on FIG. 2, so as to be engageable, from above, with the opposite side portions of the frame 69 of the dye carrier 67 at the top of the stack thereof in magazine 15. Each of feed rollers 79 is shown to have a generally circular periphery with a flattened portion 79*a* thereon (FIG. 1) so that, when flattened portions 79*a* are directed downwardly, a dye carrier 67 can be moved thereunder independently of the feed mechanism 77.

In the operation of apparatus 10, as so far described, a dye carrier 67 is initially fed by mechanism 77 from the top of the stack in magazine 15 to a position on guide plate 59 determined by engagement of the leading edge of dye carrier 67 with stop elements 62. Then, stop elements 62 are retracted downwardly and thermal head 14 is raised, in response to turning of cams 57, with the result that heating elements 52 at the upper edge of thermal head 14 press the dye coated sheet 68 of carrier 67 against a paper sheet PP wrapped about platen roller 12. Upon turning of platen roller 12 about its axis in the clockwise direction from the position shown on FIG. 17, for example, paper sheet PP and dye coated sheet 68 are moved or shifted together in the direction transverse to the straight line along which heating elements 52 are spaced apart in response to turning of platen roller 12 about its axis. During the foregoing movement, heating elements 52 are selectively energized so as to determine the pattern with which dye will be thermally transferred from sheet 68 to the printing paper PP. However, due to the gaps g between heating elements 52, the transfer of dye in such gaps will be deficient, thereby degrading the density of the printing and the resolution and quality of the resulting image. In fact, if the ratio of the gap g to the pitch p of heating elements 52 is 10%, and the density of the increments of the image formed by heating elements 52 is assumed to be 2 (at a reflection factor of $10^{-2}$), the overall density D of the image is given by the following equation:

$$D = \log_{10}(1/\text{reflection factor})$$

Therefore, $$D = \log_{10}[1/(10^{-2} \times 90 \times 10^{-2}) + (1 \times 10 \times 10^{-2})]$$
$$= \log_{10}(1/0.109) = \log_{10}9.2$$
$$D = 0.96$$

Thus, even though the gaps g are only one-tenth as wide as the pitch p, the overall density, that is, the density of the image as a whole, may be reduced by such gaps to less than one-half the density at the increments or parts of the image corresponding to the actual heating elements.

Generally, in accordance with this invention, the foregoing problem is avoided, that is, the overall density of the image obtained by thermal transfer printing is increased, by shifting platen roller 12 and thermal head 14 relative to each other in the direction of the straight line along which heating elements 52 are arranged. More particularly, in printing a full color image composed of various different color components including a black component, platen roller 12 and thermal head 14 are shifted relative to each other, as aforesaid, by one-half the pitch p between heating elements 52 when printing the black component of the image so that the black dye material will be transferred to the printing paper PP wrapped about platen roller 12 at interstices between the transferred dye materials constituting the other color components of the printed image.

Figure 8:
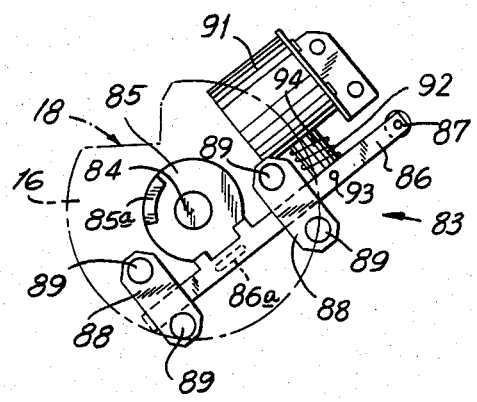

In the thermal transfer printing apparatus 10 according to this invention, as illustrated in the drawings, the relative shifting of platen roller 12 and thermal head 14 in the direction of the straight line along which heating elements 52 are arranged on thermal head 14 is made possible by mounting platen roller 12 for axial, as well as rotary movements relative to side frame members 11*a* and 11*b*. A wavy or undulating spring washer 80 is interposed axially between side frame member 11*a* and a radial shoulder 81 on axle portion 17*a* of the platen roller for urging the latter axially in the direction of the arrow 82 to a first axial position shown on FIG. 3. A platen shift mechanism 83 is shown on FIGS. 3, 8 and 20 to be associated with an extension 84 of end portion 17*b* of the platen roller axle. The mechanism 83 is shown to include a cam member 85 fixed on extension 84 of the axle to define a radial surface on the platen roller 12 facing axially in the direction in which the platen roller is urged by undulating spring 80. A displacing lever 86 is pivotally mounted at one end, as at 87, for pivotal movement relative to side frame member 11*b* in a vertical plane disposed outwardly in respect to the radial surface on cam 85. In order to stabilize displacing lever 86 in its pivotal movements, mechanism 83 further includes bearing plates 88 mounted on posts 89 extending outwardly from side frame member 11*b* above and below lever 86 which is slidable against the inner surfaces of bearing plates 88. As shown particularly on FIG. 8, the outwardly facing radial surface of cam 85 has a recess 85*a* which also opens at the periphery of cam 85. Such recess 85*a* is positioned rotationally relative to recess 18 in platen roller 12 so that, when recess 18 is directed downwardly, as on FIG. 20, cam recess 85*a* will be disposed in radial registration with a projection 86*a* directed inwardly from displacing lever 86.

Figure 20:
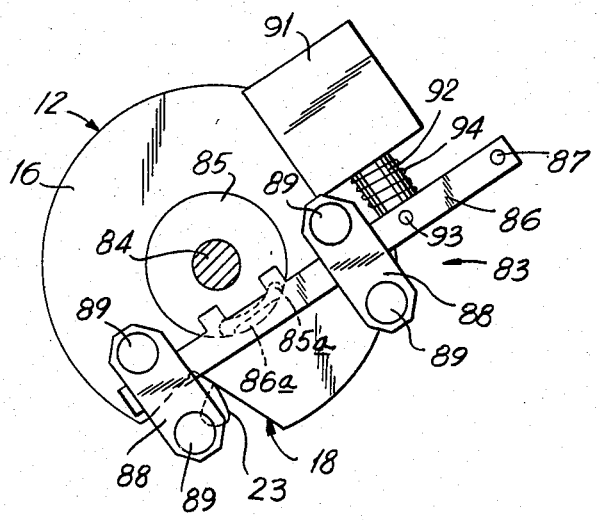
FIG. 20 is an enlarged side elevational view similar to that of FIG. 8, but showing the platen roller shifting mechanism in another condition thereof.

It will be appreciated that displacing lever 86 is movable angularly, within the limits imposed by posts 89, between an inactive position (FIG. 8) in which projection 86*a* on lever 86 is radially outside the periphery of cam 85, and an active position (FIG. 20) in which projection 86*a* is radially within the periphery of cam 85 for engagement in cam recess 85*a* when platen roller 12 is in the rotational position shown on FIG. 20. Of course, when platen roller 12 is turned from the rotational position shown on FIG. 20 with displacing lever 86 in its active position, projection 86*a* rides against the radial surface of cam 85 and thereby displaces platen roller 12 axially against the force of spring 80 in the direction of the arrow 90 on FIG. 3.

In order to selectively move displacing lever 86 between its active and inactive positions, mechanism 83 is shown to further include a solenoid 91 secured to side frame member 11*b* and having its armature 92 pivotally connected, as at 93, to displacing lever 86. When solenoid 91 is de-energized, a helical spring 94 on armature 92 urges the latter to its extended position (FIG. 8) for moving displacing lever 86 to its inactive position. On the other hand, when solenoid 91 is enrgized, its armature 92 is retracted against the force of spring 94 for moving lever 86 to its active position, as shown on FIG. 20.

Figure 23:
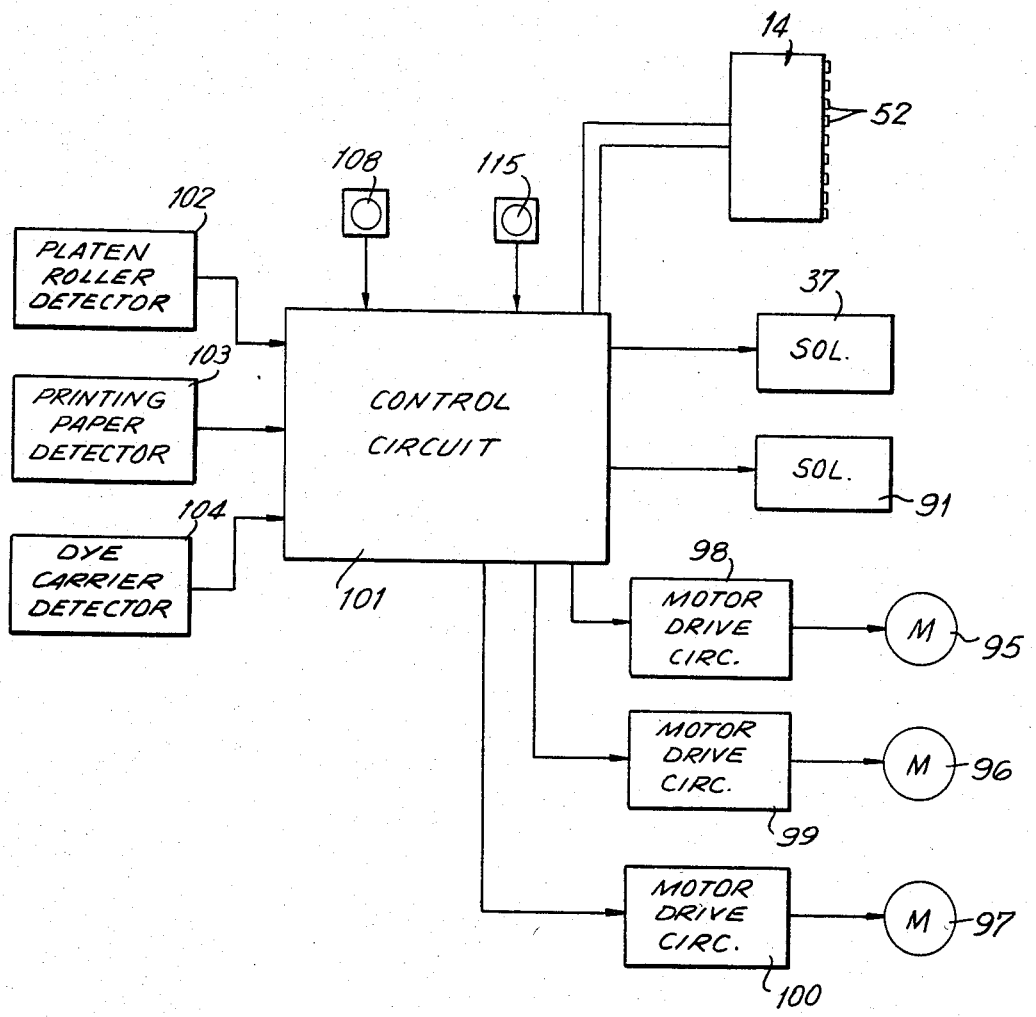
FIG. 23 is a block diagram generally illustrating components by which operations of the apparatus embodying this invention may be controlled.

For the purpose of effecting the hereinafter described operations of apparatus 10, the latter may be provided with motors 95, 96 and 97 (FIG. 23) which are coupled, as by suitable mechanisms (not shown), to shaft extension 84 of platen roller 12, to shaft 78 of dye carrier feed mechanism 77, and to shaft 58 for cams 57, respectively, and which have their operations suitably controlled through respective motor drive circuits 98, 99 and 100. More particularly, the operations of motors 95, 96 and 97, and the energization of solenoids 37 and 91 and of heating elements 52 of thermal head 14 are controlled, as hereinafter described, by a control circuit 101 which may include a microprocessor or central processing unit (CPU), and which responds to signals from a platen roller detector 102 for indicating various rotational positions of platen roller 12, a printing paper detector 103 for indicating various positions of printing paper PP being manually advanced to platen roller 12 along paper guide assembly 13, and a dye carrier detector 104 for indicating the presence or absence of a dye carrier 67 being fed from magazine 15 and over guide plate 59.

Figure 9:
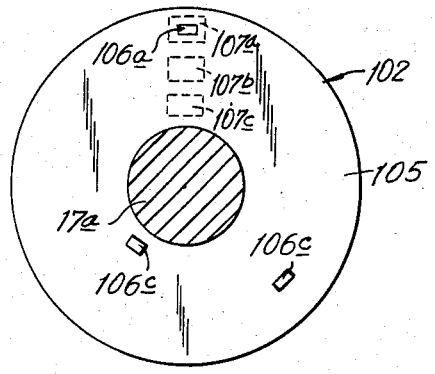
FIG. 9 is a schematic side elevational view illustrating an arrangemennt for detecting rotational positions of the platen roller in the illustrated embodiment of the invention.

As shown particularly on FIG. 9, the platen roller detector 102 may comprise a circular plate 105 rotatable with trunion 17*a* of the platen roller 12 and being formed with apertures 106*a*, 106*b* and 106*c* at various angular positions about the axis of rotation of the platen roller, and at respectively different radial distances from such axis. The platen roller detector 102 further is shown to include photosensors 107*a*, 107*b* and 107*c* arranged at the same radial distances from the axis of rotation of platen roller 12 as apertures 106*a*, 106*b* and 106*c*, respectively, and being disposed along a common radius from the axis of rotation. It will be apparent that photosensors 107*a*, 107*b* and 107*c* are operative to detect apertures 106*a*, 106*b* and 106*c*, respectively, when platen roller 12 is disposed in different respective rotational positions, as hereinafter described in detail.

As shown on FIGS. 1 and 5, printing paper detector 103 may desirably include a first photosensor 103*a* disposed above an aperture 20*a* in flap 20 (FIG. 2) for detecting the presence under such aperture 20*a* of a sheet of printing paper being manually advanced or propelled along paper guide assembly 13, and a second photosensor 103*b* positioned so as to be located above recess 18 of platen roller 12 in the initial position of the latter shown on FIG. 5, and being operative to detect or sense the arrival of the leading end edge of a sheet of printing paper against the stop surface 18*a* of recess 18.

Finally, as shown on FIG. 1, the dye carrier detector 104 includes a photosensor 104*a* disposed above guide plate 59 adjacent the aperture 61 in the latter for detecting the presence or absence of a dye carrier 67 at the respective location, and also, by means of the cutout 70 in the frame 69 of the dye carrier, the color of the dye material with which the respective sheet 68 is coated.

The operation of the thermal transfer printing apparatus 10 embodying this invention will now be described in detail.

Starting with platen roller 12 in the rotational position shown on FIGS. 1 and 5, which position is indicated by the photosensor 107*a* of detector 102 sensing the aperture 106*a*, as on FIG. 9, the insertion by the operator of a sheet of printing paper PP into channel 19 of paper guide assembly 13, and more particularly the arrival of the leading edge of the inserted paper PP under aperture 20*a* of flap 20 is sensed by photosensor 103*a* of printing paper detector 103 and, in response thereto, control circuit or CPU 101 causes energizing of solenoid 37. In response to such energizing of the solenoid 37 of actuating mechanism 33 while platen roller 12 is in its initial position, actuating lever 34 is pivoted in the clockwise direction to the position shown on FIG. 12 and causes pin 36 to displace bolt member 31 in the direction of arrow 32 to act against operating arm 26 of paper gripping mechanism 22 for releasing the gripping cam 23 of the latter. Thus, gripping cam 23 is raised from surface 18*b* of recess 18 and the leading edge portion of the printing paper sheet PP can be further inserted along surface 18*b* under cam 23 until the leading edge of the paper sheet abuts against stop surface 18*a*. During such insertion of the paper sheet into recess 18, flap 20 bears downwardly on the sheet to maintain the latter flat against surface 18*b*.

When the leading edge of printing paper sheet PP extends under cam 23 and abuts against stop surface 18*a*, such leading edge is sensed by photosensor 103*b* of detector 103. Thereafter, when the operator depresses a "start" button 108 (FIG. 23), control circuit 101 de-energizes solenoid 37 so that spring 40 on armature 38 causes extension thereof for pivoting actuating lever 34 in the counterclockwise direction, that is, for moving pin 36 away from bolt member 31, as on FIG. 13. Thus, spring 27 can pivot operating arm 26 in the clockwise direction for causing gripping cam 23 to securely grip or clamp the leading edge portion of the printing paper sheet PP against surface 18*b* of recess 18.

Figure 14:
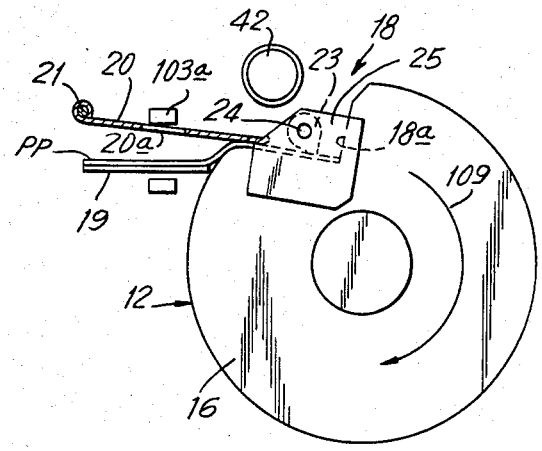
FIGS. 14 and 15 are views similar to that of FIGS. 12 and 13, but omitting structure for releasing the paper gripping mechanism, and showing the platen roller in successively further turned positions for illustrating the wrapping of the printing paper thereabout.
Figure 15:
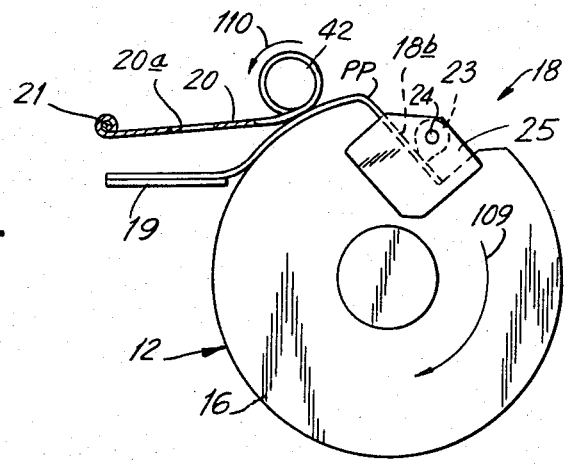

Simultaneously with such engagement of paper gripping mechanism 22, control circuit 101 causes motor drive circuit 98 to operate motor 95 in the direction for causing platen roller 12 to turn in the clockwise direction, as indicated by the arrows 109 on FIGS. 14 and 15, so that the printing paper sheet PP is wrapped about the peripheral surface of the platen roller. At the commencement of the turning of platen roller 12 from its initial position, that is, so long as recess 18 faces toward tension roller 42 so that the latter does not act on the printing paper sheet PP, the weight of pivoted flap 20 resting on the paper sheet provides sufficient frictional drag for tensioning the sheet and insuring its smooth contact with platen roller 12 at the start of the wrapping operation, as shown on FIG. 14. As the turning of platen roller 12 continues in the direction of the arrow 109, as shown on FIG. 15, tension roller 42 comes into rolling contact with the printing paper sheet PP on the peripheral surface of the platen roller so as to urge tension roller 42 to turn in the counterclockwise direction, as indicated by the arrow 110. Such turning of tension roller 42 in the counterclockwise direction is frictionally resisted, as earlier described, by the one-way clutch mechanisms 48 and the drag imposing washers 49 and springs 50 so that the printing paper sheet PP is maintained under tension for its smooth wrapping about platen roller 12.

Figure 16:
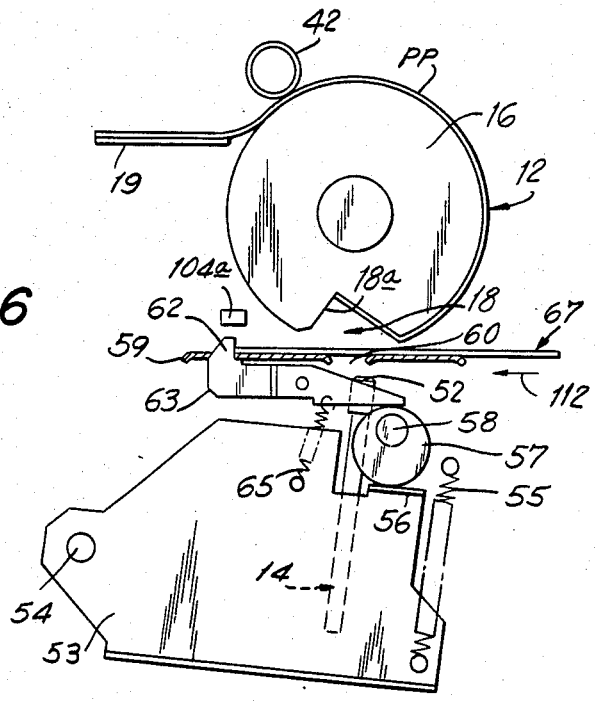
FIGS. 16, 17, 18 and 19 are enlarged side elevational views corresponding to a portion of the structure shown in FIG. 1, but illustrating various phases in the operation of the apparatus embodying the invention.

When platen roller 12 has been turned to the position shown on FIG. 16, that is, the rotational position in which recess 18 is at the bottom of the platen roller, such rotational position of platen roller 12 is detected by detector 102 in response to the sensing of aperture 106*b* by detector 107*b*. As a result of the foregoing detection, control circuit 101 causes motor drive circuit 98 to temporarily halt the operation of motor 95, that is, to temporarily halt the turning of platen roller 12, while motor drive circuit 99 is made to cause operation of motor 96 by which shaft 78 of dye carrier feed mechanism 77 is rotated in the direction of the arrow 111 on FIG. 1 from the initial position in which flattened surface portion 79*a* of feed rollers 79 face downwardly. As feed rollers 79 are turned in the direction of the arrow 111 on FIG. 1, the peripheries of feed rollers 79 come into rolling contact with the frame 69 of the uppermost dye carrier 67 in magazine 15 so as to propel the engaged dye carrier 67 out of magazine 15 and on to guide plate 59 in the direction of the arrow 112 on FIG. 16. The first dye carrier 67 thus fed out of magazine 15 is, as previously indicated, one of a set of four dye carriers, and its paper sheet 68 is coated with cyan dye. Since recess 18 of platen roller 12 is facing downwardly during the feeding of the first dye carrier 67 out of magazine 15, there is a gap or clearance between the upper surface of the dye carrier 67 being fed over guide plate 59 and the printing paper sheet PP on platen roller 12, as is clear from FIG. 16. Further, as is shown on that view of the drawings, during the feeding of dye carrier 67 from magazine 15 and onto guide plate 59, cams 57 are disposed to depress mounting member or carriage 53 against the force of springs 55 so that thermal head 14 is below guide plate 59, and further to permit springs 65 to pivot stop levers 63 to their operative positions in which stop elements 62 project above the surface of guide plate 59. Thus, as feed rollers 79 turn through approximately one revolution and return to positions in which the flat surface portions 79*a* again face downwardly to release the uppermost dye carrier 67, the leading end edge of such dye carrier comes into engagement with, and is positively positioned by stop elements 62, as shown on FIG. 16.

Figure 17:
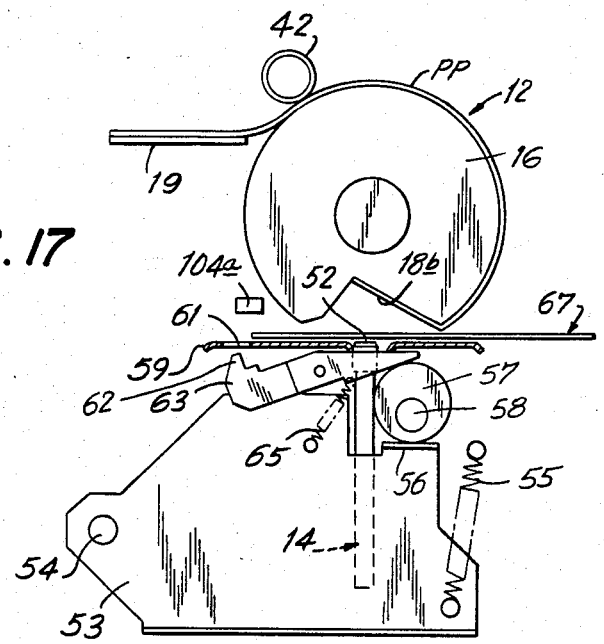

When the leading end edge of the dye carrier 67 being fed out of magazine 15 by feed mechanism 77 abuts stop elements 62, such leading end edge and the color of the respective dye coated paper 68 are detected by photosensor 104*a* of dye carrier detector 104 and, in response thereto, control circuit 101 causes motor drive circuit 100 to momentarily operate motor 97 for turning cam shaft 58 through one-half revolution, that is, for turning cams 57 from the position shown on FIG. 16 to the position shown on FIG. 17. Such turning of cams 57 permits springs 55 to raise mounting member 53 so that heating elements 52 of thermal head 14 extend upwardly through slot 60 of guide plate 59, while stop levers 53 are rocked to their inoperative positions in which stop elements 62 are retracted below guide plate 59. Upon the turning of cams 57 to the position shown on FIG. 17, control circuit 101 causes motor drive circuit 98 to restart the turning of platen roller 12 in the clockwise direction, as viewed on FIG. 17 and, at the same time, supplies to the heating elements 52 of thermal head 14 printing signals representing a color component of an image to be printed corresponding to the color of the dye coating the paper 68 of the dye carrier 67 then positioned on guide plate 59. As platen roller 12 turns in the clockwise direction from the position shown on FIG. 17, the printing paper sheet PP wrapped about its peripheral surface comes into rolling contact with the dye coated sheet 68 of the dye carrier 67 and presses downwardly against heating elements 52 of thermal head 14 to such an extent that mounting member 53 is slightly pivoted downwardly to space its flanges 56 from cams 57. Thus, ink or dye coating paper 68 is thermally transferred to the sheet of printing paper PP in accordance with the selective energization of heating elements 52 while platen roller 12 is turned and, in response thereto, dye carrier 67 is moved across guide plate 59. During the resulting printing of the respective color component of the image represented by the printing signal being supplied from control circuit 101, the spacing of flanges 56 on mounting member 53 from cams 57 ensures that a proper printing pressure will be maintained at all times by springs 55.

Figure 18:
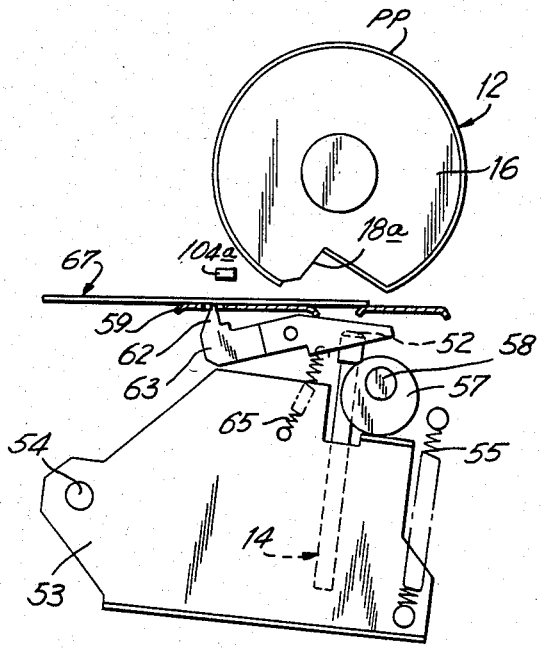

When printing of the first or cyan color component of the image has been completed, that is, when platen roller 12 has been turned through a full revolution in the clockwise direction from the position shown on FIG. 17 to the position shown on FIG. 18, such position of platen roller 12 is again detected by the sensing of aperture 106*b* by photosensor 107*b*. In response to such detection, control circuit 101 causes motor drive circuit 98 to halt the operation of motor 95, that is, to halt the rotation of platen roller 12 in the position shown on FIG. 18, and control circuit 101 further causes motor drive circuit 101 to operate motor 97 for causing turning of cams 57 through one-half revolution to the position shown on FIG. 18. As shown, such turning of cams 57 causes mounting member 53 to be depressed so that thermal head 14 is again retracted below guide plate 59. However, since the trailing end portion of the dye carrier 67 used for printing the cyan component of the image remains on guide plate 59, stop elements 62 cannot project above the latter under the influence of springs 65 acting on stop levers 63. In such case, a suitable dye carrier removal or take-out mechanism (not shown) may be actuated to remove the previously used dye carrier 67 from guide plate 59, whereupon springs 65 can again angularly displace stop levers 63 for projecting their stop elements 62 above guide plate 59, as shown on FIG. 19. Further, in response to the removal of the previously used dye carrier 67 from guide plate 59, photosensor 104*a* detects the absence of a dye carrier on guide plate 59, whereupon control circuit 101 again causes motor drive circuit 99 to operate motor 96 for causing the dye carrier feed mechanism 77 to feed the second dye carrier 67 of a set, that is, the dye carrier having its paper sheet 68 coated with magenta dye, out of magazine 15 and onto guide plate 59 to be initially positioned by stop elements 62 and detected by photosensor 104*a*. Thereafter, the apparatus 10 operates to transfer the magenta color component of the image to the printing paper sheet PP wrapped about platen roller 12 in substantially the same manner as has been described above in respect to the transfer of the first or cyan color component.

Upon the completion of the printing or transferring of the magenta color component of the image, the respective dye carrier 67 is removed from guide plate 59 and feed mechanism 77 is again made operative, as previously described, to feed the third dye carrier 67, that is, the dye carrier having its sheet 68 coated with yellow dye, from magazine 15 onto guide plate 59 for initiation of another operation of apparatus 10 by which the yellow color component of the image is transferred or printed on the printing paper sheet PP wrapped about platen roller 12.

Figure 22:
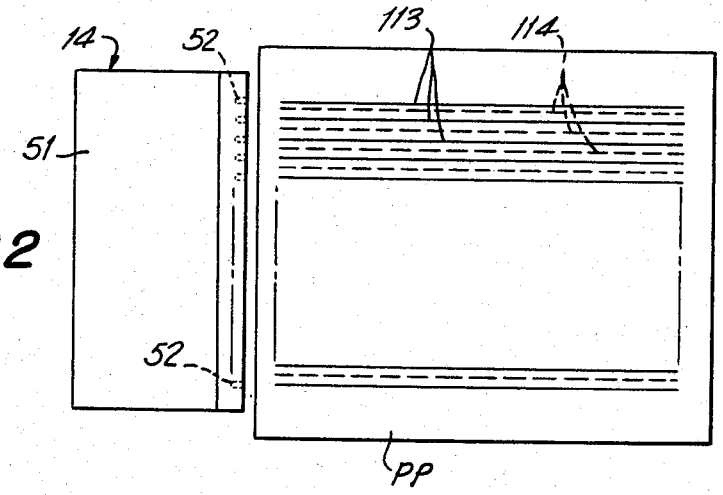
FIG. 22 is a diagramatic view illustrating the thermal head and the pattern with which such head provides a thermally transferred image on the printing paper in accordance with this invention.

At the completion of the printing of the yellow color component and the removal of the respective dye carrier 67 from guide plate 59, the renewed operation of feed mechanism 77, as previously described, causes the feeding from magazine 15 of the fourth dye carrier 67 of a set, that is, the dye carrier having its sheet 68 coated with black dye. When such black dye carrier comes to rest against stop elements 62, as on FIG. 16, photosensor 104*a* detects the presence of the dye carrier and, in cooperation with the distinctive cutout 70 in the frame 69 thereof, identifies the dye carrier as the fourth of a set, that is, as a black dye carrier. In response to the detection of a black dye carrier 67 by photosensor 104*a*, control circuit 101 energizes solenoid 91 to pivot lever 86 to its active position in which projection 86*a* is within the periphery of cam surface 85. Since solenoid 91 is thus energized at a time when recess 85*a* of cam surface 85 registers with projection 86*a*, the latter enters the cam recess 85*a*, as shown on FIG. 20. Accordingly, during the printing of the black color component of the image, that is, when platen roller 12 is turned in the clockwise direction from the position shown on FIG. 20, recess 85*a* in cam surface 85 moves away from projection 86*a* so that the latter rides on the flat or radial surface of the cam 85. Since lever 86 is backed up by bearing plates 88, the engagement of projection 86*a* with the flat or radial surface of cam 85 causes axial displacement of platen roller 12 against the force of spring 80 by a distance preferably equal to one-half the pitch p of the heating elements 52. Thus, as illustrated on FIG. 22, if the heating elements 52 scan along the solid lines 113 on printing paper sheet PP when transferring the cyan, magenta and yellow color components of the image, then the heating elements 52 will scan along the broken lines 114 between the lines 113 when transferring the black component of the image. In other words, in accordance with the present invention, the black dye will be transferred or applied to the printing paper sheet PP in the minute spaces or gaps between the locations along which the cyan, magenta and yellow dyes are applied. By reason of the foregoing, the density and resolution of the resulting full-color image is very substantially enhanced.

Figure 19:
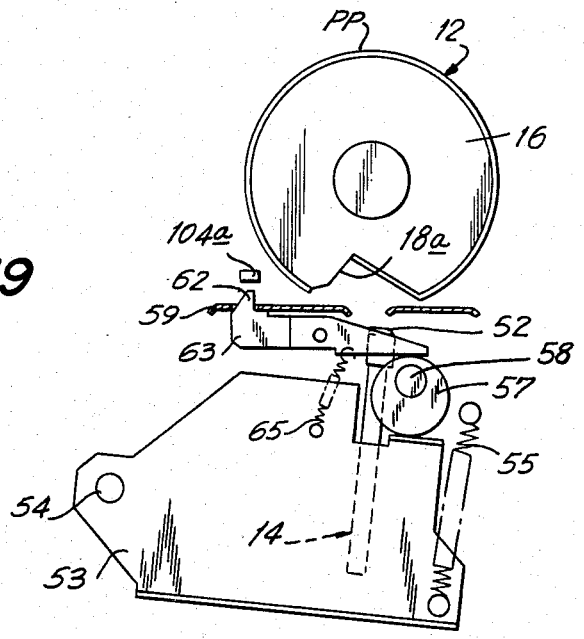

When platen roller 12 returns to the rotational position shown on FIGS. 19 and 20 at the completion of the printing or transfer of the black component of the image, projection 86*a* is again received in the recess 85*a* of the cam so that the undulating washer 80 can urge the platen roller 12 to return axially to its original position, that is, the axial position of platen roller 12 in which the cyan, magenta and yellow color components have been printed. Further, at the return of platen roller 12 to its rotational position shown on FIGS. 19 and 20, that is, when aperture 106*b* is sensed by photosensor 107*b* at the completion of the black printing operation, control circuit 101 causes de-energizing of solenoid 91 for pivoting lever 86 so as to move projection 86*a* radially outside the periphery of cam 85. Then, control circuit 101 causes motor drive circuit 98 to operate motor 95 in the direction for turning platen roller 12 in the clockwise direction from the position shown on FIGS. 19 and 20 to the position shown on FIG. 21.

Figure 21:
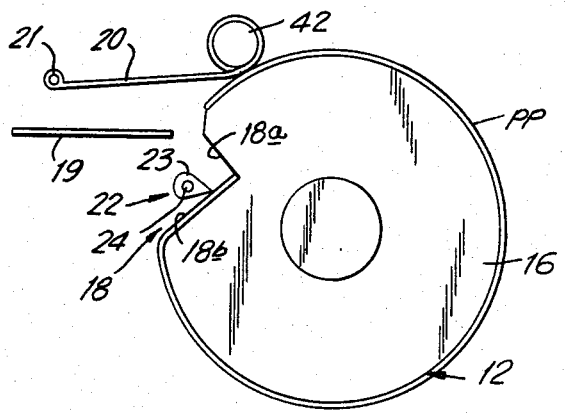
FIG. 21 is a view similar to that of FIGS. 14 and 15, but showing the platen roller immediately prior to its reverse rotation for unwrapping the printing paper therefrom at the completion of a printing operation.

The position of platen roller 12 shown on FIG. 21 following the completion of the printing of a full-color image on printing paper sheet PP is detected by the sensing of aperture 106*c* by photosensor 107*c*. When photosensor 107*c* detects aperture 106*c* and, simultaneously, photosensor 104*a* does not detect a dye carrier 67 on guide plate 59 by reason of the completion of the printing of a full-color image, control circuit 101 causes motor drive circuit 98 to halt the operation of motor 95 with the platen roller in the position shown on FIG. 21. After halting rotation of platen roller 12 in the position shown on FIG. 21, control circuit 101 causes motor drive circuit 98 to effect reverse operation of motor 95 for turning platen roller 12 in the counterclockwise direction from the position shown on FIG. 21. With platen roller 12 in the position shown on FIG. 21, the end edge of the printed paper sheet PP remote from gripping mechanism 22 is located above the bottom of the channel 19 and, at the commencement of the turning of platen roller 12 in the counterclockwise direction, such end edge portion is guided onto channel 19 by flap 29 for discharge of the printed paper sheet along the latter. It will be appreciated that, during the counterclockwise rotation of platen roller 12, tension roller 42 is freely rotatable in the clockwise direction, as viewed on FIG. 21, by its rolling contact with the paper wrapped about platen roller 12 so that tension roller 42 does not interfere with the smooth discharge of the printed paper sheet onto guiding channel 19.

Figure 13:
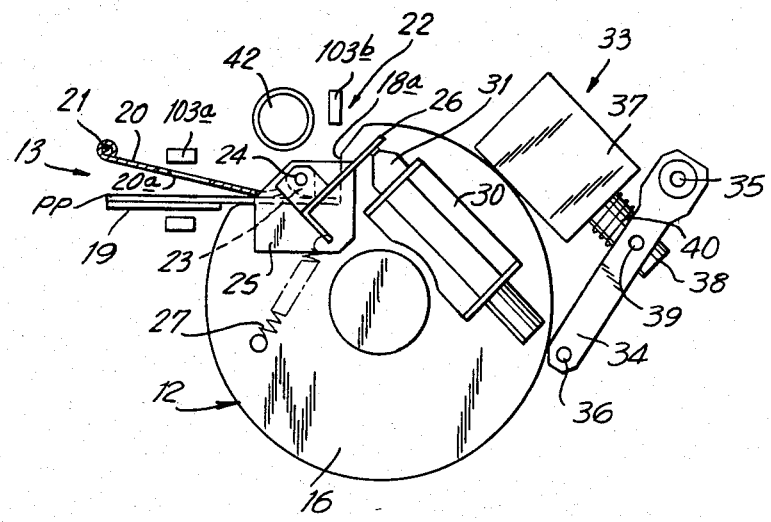

When photosensor 107*a* detects aperture 106*a*, that is, when platen roller 12 has returned to the position shown on FIG. 13 in the course of its counterclockwise turning, control circuit 101 causes motor drive circuit 98 to halt the reverse operation of motor 95 and platen roller 12 comes to rest in the position shown on FIG. 13. Thereafter, when the operator depresses a print-end button 115 (FIG. 23), control circuit 101 causes energizing of solenoid 37 to attract its armature 38, as on FIG. 12, so that gripping cam 23 is released to free the end of the printed paper sheet within recess 18 and to permit the operator to remove the printed paper sheet from the paper guide assembly 13. In the course of such removal of the printed paper sheet from guide assembly 13, photosensors 103*b* and 103*a* successively detect the absence of the paper sheet from recess 18, and then from under aperture 20*a* in flap 20 and, in response thereto, control circuit 101 causes de-energizing of solenoid 37 to permit spring 27 to restore gripping cam 23 to its engaged position against surface 18*b*. Thus, the printing cycle of apparatus 10 is completed.

It will be appreciated that, in modifications of the above-described embodiment of the invention, the operating arm 26 of paper gripping mechanism 22 may be directly operated by the armature 38 of solenoid 37, thereby avoiding the need for bolt member 31 and actuating lever 34. Further, the mechanism described above for alternately moving stop elements 62 and thermal head 14 to their operative positions above guide plate 59 may be replaced by other similarly operating devices, for example, by a pinion replacing cam 57 and being engaged at its opposite sides by gear racks for effecting the reverse vertical movements of the stop elements 62 and the thermal head 14.

It is also to be noted that the cam 85 formed independently of the body 16 of platen roller 12 may be replaced by an end surface of the roller body 16 which has the recess 85*a* formed directly therein. It will also be appreciated that, in the mechanism 83 for effecting axial shifting of platen roller 12 in accordance with this invention, the spring 94 on the solenoid armature 92 may be omitted if the weight of lever 86 is sufficient to return such lever to its inactive position upon de-energizing of solenoid 91. It is further to be appreciated that the plate 105 mounted on the trunion 17*a* of platen roller 12 and having the apertures 106*a*, 106*b* and 106*c* therein can be omitted and, in such case, suitably coded indicia may be provided at respective locations on the end surface of roller 12 for cooperation with a single photosensor in detecting the rotational position of the platen roller.

It is still further to be noted that, although the apparatus 10 according to this invention employs a mechanism 83 which shifts the platen roller 12 in the axial direction, a similar effect may be achieved in accordance with this invention by shifting the thermal head 14 in the direction of the axis of the platen roller 12 while the latter is held against axial displacement.

Although an illustrative embodiment of this invention, and various modifications thereof have been described in detail herein, it is to be appreciated that the invention is not limited to that precise embodiment or the specifically described modifications, and that various other changes and variations can be effected therein by one skilled in the art without departing from the scope or spirit of the invention as defined in the appended claims.

What is claimed is:

1. A thermal transfer printing apparatus for printing an image on a sheet of printing paper comprising:

a rotatable platen roller having a surface for backing-up said sheet of printing paper;

means for wrapping said sheet of printing paper about said surface of the roller;

a thermal head having a plurality of selectively energizable heating elements confronting said surface of the platen roller and arranged substantially along a straight line parallel with the axis of rotation of said roller;

ink carrying means for positioning thermally transferable dye material between said heating elements and said printing paper backed-up by said surface of the roller;

means for pressing said thermal head toward said roller with said ink carrying means and the sheet of printing paper therebetween for the selective transfer of said dye material to said printing paper in dependence on the selective energization of said heating elements;

first shifting means for rotating said roller and thereby moving said thermal head and said printing paper relative to each other in a direction extending transversely in respect to said straight line;

means for operating said ink carrying means, said means for pressing and said thermal head synchronously with said first shifting means so as to print said image on said sheet of printing paper wrapped about said surface of the roller in the course of a plurality of complete revolutions of the roller;

second shifting means for moving said thermal head and said sheet of printing paper relative to each other in a direction along said straight line; and means for actuating said second shifting means to relatively move said thermal head and said sheet of printing paper in an interval between said complete revolutions of the roller required for the printing of said image on said sheet of printing paper.

2. A thermal transfer printing apparatus according to claim 1; in which said surface of the roller is elastic.

3. A thermal transfer printing apparatus according to claim 1; in which said second shifting means is operative to displace said platen roller in said direction along said straight line for thereby effecting said relative movement of the sheet of printing paper and said thermal head in said direction along said straight line.

4. A thermal transfer printing apparatus according to claim 3; in which said ink carrying means includes sets of sheets carrying thermally transferable dyes of respectively different colors, and further comprising means for interposing said sheets of a set, one-by-one in a predetermined sequence, between said heating elements and the sheet of printing paper wrapped about said roller during corresponding successive revolutions of said roller.

5. A thermal transfer printing apparatus according to claim 4; in which said different colors are cyan, magenta, yellow and black, respectively, so that each of said sets includes four of said sheets and a full color image is formed on a sheet of printing paper wrapped about said roller upon the completion of a cycle of four respective complete revolutions of the latter.

6. A thermal transfer printing apparatus according to claim 9; in which said second shifting means maintains said roller relative to said thermal head in a first position in said direction along said straight line during three of said revolutions of each of said cycles in which cyan, magenta and yellow dye materials, respectively, are transferred to the printing paper and, for the fourth revolution of each of said cycles in which black dye material is transferred, said second shifting means relatively moves said roller and thermal head from said first position to a second position through a distance along said straight line which is approximately one-half the pitch of said heating elements.

7. A thermal transfer printing apparatus according to claim 6; in which said heating elements of the thermal head are arranged with gaps therebetween along said straight line for minimizing the extent to which each heating element is heated by energizing of adjacent heating elements; and in which, in said second position of said roller and thermal head relative to each other, said heating elements are at the locations on said roller occupied by said gaps between said heating elements in said first position of the thermal head.

8. A thermal transfer printing apparatus according to claim 1; in which said heating elements of the thermal head are arranged with gaps therebetween along said straight line for minimizing the extent to which each heating element is heated be energizing of adjacent heating elements, and in which said second shifting means is operative to effect said relative movement of the thermal head and printing paper a distance along said straight line which is approximately one-half the pitch of said heating elements so that, when said second shifting means is operative, said heating elements are approximately at the locations on said roller occupied by said gaps in the inoperative condition of said second shifting means.

9. A thermal transfer printing apparatus according to claim 1; in which said means for wrapping a sheet of said printing paper about said platen roller includes sheet guide means extending adjacent to said surface on the platen roller, sheet gripping means on said platen roller operative on rotation of said platen roller in one direction for gripping a leading edge at one end of a sheet of printing paper fed to said roller along said guide means, and sheet tensioning means engaging a sheet of printing paper gripped by said gripping means for yieldably resisting movement of the gripped sheet with said platen roller in said one direction and thereby ensuring the smooth wrapping of the sheet on the platen roller.

10. A thermal transfer printing apparatus according to claim 9; in which said sheet tensioning means includes a tension roller, support means rotatably supporting said tension roller and yieldably pressing the latter against said surface of the platen roller adjacent said sheet guide means, and drag means yieldably resisting rotation of said tension roller by rolling contact with a sheet of printing paper on said platen roller during rotation of the latter in said one direction and freeing said tension roller to be rotated by said rolling contact during rotation of said platen roller in the opposite direction.

11. A thermal transfer printing apparatus according to claim 10; further comprising means for directing the opposite end of the sheet of printing paper from said surface of the platen roller to said sheet guide means on rotation of said platen roller in the opposite direction so as to unwrap said sheet from the platen roller.

12. A thermal transfer printing apparatus according to claim 9; in which said platen roller has a recess extending axially in said surface; and said sheet gripping means includes a gripping cam pivoted in said recess for movement between a gripping position and a released position, spring means urging said cam to said gripping position for engagement with an edge portion of a sheet of printing paper introduced into said recess, a cam releasing mechanism rotatable with said platen roller and actuable to displace said gripping cam to said released position, actuating means located for engagement with said cam releasing mechanism only when said platen roller is rotatably disposed to position said recess adjacent said sheet guide means, and solenoid means connected with said actuating means and being energizable to cause the latter to actuate said cam releasing mechanism when said platen roller positions said recess adjacent said sheet guide means.

13. A thermal transfer printing apparatus according to claim 1; in which said second shifting means includes spring means yieldably urging said platen roller axially in one direction to a first axial position, a radial surface on said platen roller facing axially in said one direction, a displacing lever movable from an inactive position to an active position to engage said radial surface for displacing said platen roller axially in the other direction against the force of said spring means to a second axial position, and solenoid means connected with said lever for selectively disposing the latter in said active and inactive positions thereof.

14. A thermal transfer printing apparatus according to claim 13; in which said radial surface terminates at an outer periphery and has a recess opening axially and radially outward at said periphery, and said displacing lever has a projection thereon which is movable generally radially in respect to said radial surface so as to be outside said periphery in said inactive position of the lever and within said periphery in said active position for engagement in said recess in one rotary position of said platen roller, whereby, with said displacing lever in said active position, rotation of said platen roller from said one rotary position, causes disengagement of said projection from said recess to act against said radial surface for said displacing of the platen roller to said second axial position.

15. A thermal transfer printing apparatus according to claim 1; in which said ink carrying means includes sheets bearing said thermally transferable dye material, magazine means for storing a plurality of said sheets bearing dye material, and means for feeding said sheets bearing dye material one-by-one from said magazine means in a path tangential to said surface of the platen roller between the latter and said thermal head.

16. A thermal transfer printing apparatus according to claim 15; in which said means for pressing said thermal head toward said platen includes a mounting member for said thermal head movable toward and away from said path; and further comprising stop means movable into and out of said path, and actuating means for said mounting member and said stop means moving the latter into said path for establishing an initial position for a sheet bearing dye material fed from said magazine means when said mounting member is moved away from said path, and moving said stop means out of said path when said mounting member is moved toward said path so that a sheet bearing dye material is pressed by said thermal head against a sheet of printing paper on the platen roller and is fed beyond said initial position in response to rotation of said platen roller.

17. A thermal transfer printing apparatus according to claim 16; in which said actuating means includes spring means urging said mounting member in the direction for pressing said thermal head against said platen roller and urging said stop means into said path, and cam means acting simultaneously on said stop means and said mounting member under the urging of said spring means.

* * * * *